United States Patent [19]

Rait

[11] 4,288,919

[45] Sep. 15, 1981

[54] SAFETY RAZOR WITH MEANS TO SLIDABLY MOUNT CARTRIDGE

[76] Inventor: Joseph M. Rait, 1100 Amherst St., Buffalo, N.Y. 14216

[21] Appl. No.: 31,470

[22] Filed: Apr. 19, 1979

[51] Int. Cl.[3] ..... B26B 21/06; B26B 21/52

[52] U.S. Cl. ..... 30/47; 30/85

[58] Field of Search ..... 30/32, 44, 46, 47, 51, 30/85

[56] References Cited

U.S. PATENT DOCUMENTS

| | | | |
|---|---|---|---|
| 1,552,543 | 9/1925 | Conill | 30/44 |
| 2,060,635 | 11/1936 | Parkin | 30/46 |
| 2,262,476 | 11/1941 | Sussman | 30/44 |
| 2,510,612 | 6/1950 | Wahnish | 30/44 X |
| 3,934,339 | 1/1976 | Dawidowicz | 30/47 |

*Primary Examiner*—Gary L. Smith
*Attorney, Agent, or Firm*—E. Herbert Liss

[57] ABSTRACT

In a safety razor the blade is retained in a manner to permit limited movement relative to the handle in the direction of its longitudinal axis. This is accomplished with blade elements of the type comprising a blade mounted in a cartridge by retaining the blade cartridge in its receptor for movement relative to the receptor. In other embodiments, the receptor is mounted on the handle in a manner to permit limited movement of the handle in the direction of the longitudinal axis of the receptor. The latter embodiment may be employed with any safety razor having its handle positioned in angular relationship to the receptor. To enhance the relative sliding movement, a lubricant may be applied between the moving parts.

3 Claims, 3 Drawing Figures

SAFETY RAZOR WITH MEANS TO SLIDABLY MOUNT CARTRIDGE

This invention relates to safety razors and more particularly to a safety razor in which the handle and blade element are movable relative to each other in operative assembly.

Various forms of safety razors of the stated type are known such as those in which the blade is movable transversely to expose a lesser or greater portion or rotatably to better conform to various contours. Others include handles which are movable angularly to enable access to various portions of the face, neck and other portions of the body and for personal adaptability for the user. The known forms of such safety razors all have for their purpose improved accessibility to the area to be shaved. However none of these adjustable features relate to minimizing the possibility of inadvertent skin laceration.

Blade elements and blade receptors are known which are designed to minimize inadvertent skin cuts. However these primarily offer protection on vertical stroking. Cuts are often caused by an inadvertently applied lateral component of force.

The principal object of the present invention is to provide an improved safety razor which minimizes cuts due to inadvertent lateral motion.

Another object of the invention is to provide an improved razor blade for minimizing cuts in which the handle can be moved laterally without moving the blade during use.

According to the invention the safety razor includes a blade receptor and a handle extending at an angle thereto. Safety razors of the type which utilize one or more blades fixed or adjustably mounted in a plastic cartridge may contan a notch or recess which engages a fixed or movable embossment or protrusion provided on the blade receptor in a position to engage the notch to retain the blade assembly. The notch may be of greater lateral extent than the protrusion to allow the blade assembly to move laterally, that is in the direction of the longitudinal axis of the cartridge or the receptor for a limited extent. In addition the blade assembly may be in frictional engagement with one or more surfaces of the blade receptor to prevent promiscuous lateral movement. When the blade is pressed against the skin and a lateral component of force is applied inadvertently the friction forces of the blade cartridge against the skin will retain the blade immobile in a lateral direction while the handle moves laterally relative to the blade, thus preventing a slicing effect caused by application of lateral forces. The same result may be accomplished in injector type razors or disposable razors as well as cartridge type razors where the blade is held firmly in the receptor by affixing the handle to the receptor for movement relative to the receptor in a direction along the longitudinal axis of the receptor.

These and other objects and advantages of the invention will be apparent from the following detailed description taken in connection with the accompanying drawings.

Figure 1:
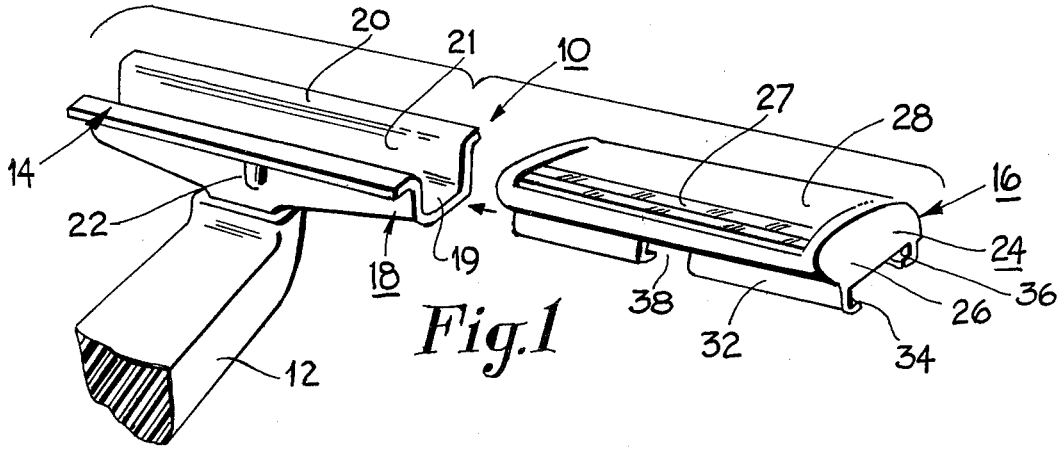
FIG. 1 is an exploded perspective of the embodiment of this invention.

Referring more particularly to the drawing there is illustrated in FIG. 1 a safety razor 10 of the cartridge type having an elongate handle 12 secured perpendicularly to a blade receptor 14 for receiving the blade cartridge 16. Although the handle shown is rigidly fixed to the blade receptor it will, of course, be understood that handles may be secured for angular adjustment relative to the receptor 14.

The blade receptor 14 as illustrated in FIG. 1 comprises a channel shaped body 18, having its web portion 19 secured substantially centrally thereof to an end of the handle 12, the longitudinal axis of the handle being disposed in angular relationship to the longitudinal axis of the receptor 18. Each upstanding leg portion 21 of the receptor body 14 terminates in an outwardly extending flange serving as a rail 20. An embossment 22 is provided centrally adjacent a flange 20 on one or both of the legs 21 for a purpose to be hereinafter described.

The blade cartridge 16 comprises a body or mounting block 24 preferably of suitable plastic material having a base 26. A blade element 27 positioned on the surface of the base 26 is retained by a blade shield 28. Depending from each lower longitudinal edge of the base 26 is a web portion 32 and an inwardly extending leg 34 the legs 34 being in opposed relationship defining opposed slots 36. The slots 36 are frictionally interengageable with respective rails 20. At least one of the legs 34 is centrally notched as at 38, the notch 38 being disposed to receive embossment or shoulder 22 on leg 21 of blade receptor 14. The notch 38 is of substantially greater width than the embossment 22 to permit the blade assembly 16 to move in the direction of its longitudinal axis in assembled condition during use. The notch edges form spaced apart shoulders to cooperate with the embossment shoulders and together constitute stop means to limit the extent of movement.

The notch 38 and embossment 22 constitute interengaging means for removably retaining the cartridge to the blade receptor.

Figure 2:
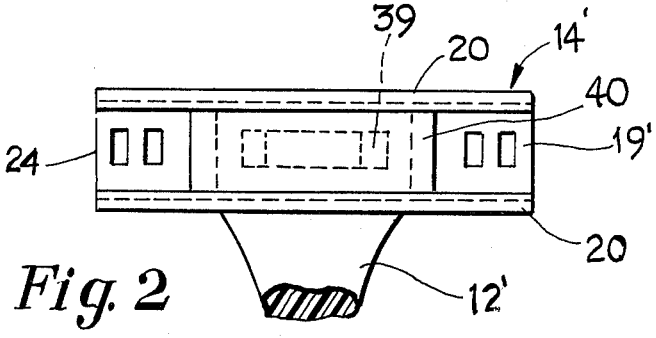
FIG. 2 is a front elevational view of a preferred embodiment of the invention.
Figure 3:
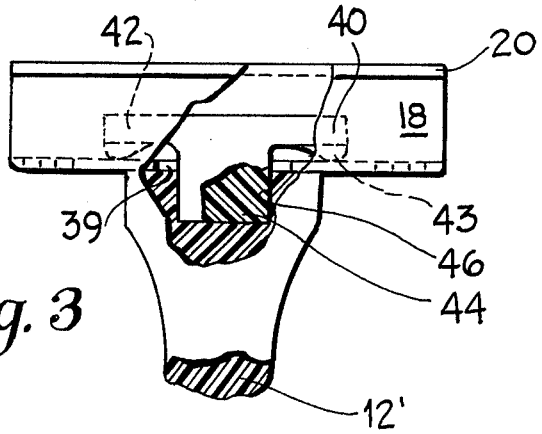
FIG. 3 is a rear elevation view partly in section.

A preferred embodiment of the safety razor as shown in FIGS. 2 and 3 includes a blade receptor 14′ of channeled configuration the same as receptor 14 with rails 20 at the free ends of legs 21. A rectangular slot 39 elongate along the longitudinal axis is provided in the web portion 19′ of blade receptor 14′. A handle retaining element 40 includes a generally rectangular portion 42 of greater length than the slot 39 and of width approximating the internal width of web portion 19 of blade receptor 14. Bearing surfaces 43 depend from the end of the lower surface of the rectangular portion 42. The rectangular portion 42 is of greater length than slot 39 and is nestled within the channel between legs 21 of the blade receptor 14′; bearing surface 43 abuts the upper surface of web 19′. The handle retaining element 40 includes a second rectangular section 44 depending from rectangular portion 42 which is of lesser length than slot 39 and is received therethrough.

The handle 12′ includes a rectangular recess 46 at one end for receiving depending rectangular section 44 in tight fitting engagement. The handle 12′ may be assembled to the receptor 14′ by inserting the rectangular section 44 into recess 46 with bearing surfaces 43 slightly in compression to effect a secure but frictional sliding assembly clamping in sliding frictional engagement the web 19′ between the end surface of handle 12′ and the bearing surfaces 43. The depending rectangular section 44 may be secured in recess 46 by any suitable or desirable means as for example a press fit, an adhesive or sonic welding. The blade cartridge 16 may be received on the blade receptor 18 in fixed position.

It should now be apparent that the handle 12 is movable relative to the blade receptor 14 in the direction of the longitudinal axis of the receptor 14; the rectangular section 44 forms a neck portion or neck means of the handle assembly which is movable within the limits of the end of slot 39. The edges of the rectangular section 44 and the ends of the slots constitute shoulders which cooperate to serve as stop means.

The neck of the handle assembly and the rectangular section 44 constitute interengaging means for securing the handle to the receptor.

It should of course be understood that in accordance with the broader aspects of the invention a handle assembly like that shown in FIGS. 2 and 3 can be applied to any type of safety razor including but not limited to injector or disposable types by securing a channel portion to the base of whatever type of blade receptor is utilized. Other and different sliding and limiting arrangements may also be employed. In these additional types of razors the blade element is generally retained directly in the receptor or equivalent structure without applying cartridge members.

During use the friction due to the blade shield 28 being pressed against the skin will resist lateral movement of the blade because either the handle assembly or the blade receptor and handle assembly together are free to move independently of the blade element when an inadvertent lateral force is applied. Anti-friction means for facilitating relative lateral movement may be applied between the blade receptor and the blade which may enhance the relative lateral movement. A lubricant as for example silicone grease or other suitable lubricating coating can serve this purpose.

It should now be apparent that an improved safety razor has been provided which minimizes the possibility of cuts in the event of an application of inadvertent lateral component of force during shaving. Certain specific embodiments have been shown and described for the purpose of illustration but it will be apparent that various other embodiments are possible within the scope of the invention. It is to be understood, therefore, that the invention is not limited to the specific arrangement shown but in its broadest aspects it includes all equivalent embodiments and modifications which come within the scope of the invention.

What is claimed is:

1. A safety razor assembly comprising a receptor, a handle extending generally perpendicularly from said receptor and a cartridge, means for mounting said cartridge on said receptor, the cartridge comprising a body and at least one blade element rigidly retained in said body, and interengaging means for permanently securing said handle to said receptor, characterized in that said interengaging means includes opposed spaced apart shoulders and guide means between said shoulders and said interengaging means to permit limited sliding motion in a line parallel to the longitudinal axis of said blade cartridge whereby said handle is movable relative to said cartridge on said line parallel to the longitudinal axis while in assembled operative condition to minimize occurrence of slicing motion of said blade element when an inadvertent sidewise force is applied to the handle.

2. A safety razor assembly comprising a receptor, a handle extending generally perpendicularly from said receptor and means for retaining a blade cartridge on said receptor, said receptor and said handle including interengaging slot and neck means for providing sliding engagement between said handle and said receptor in a line parallel to the longitudinal axis of said receptor and cooperating abutment means on said slot and neck means to limit the extent of the sliding movement.

3. A safety razor according to claim 2 wherein anti-friction means for facilitating sliding movement is applied between the interengaging slot and neck means.

* * * * *